US005944367A

United States Patent [19]

Imaizumi et al.

[11] Patent Number: 5,944,367

[45] Date of Patent: Aug. 31, 1999

[54] DOOR CLOSING APPARATUS

[75] Inventors: Tomoaki Imaizumi, Okazaki; Eiji Itami, Toyota; Hiroshi Ishihara, Kariya; Norikazu Kobayashi, Chita; Hiroyuki Mizushima, Aichi-ken; Ryujiro Akizauki, Toyota, all of Japan

[73] Assignee: Aisin Seiki Kabushiki Kaisha, Kariya, Aichi, Japan

[21] Appl. No.: 08/842,358

[22] Filed: Apr. 24, 1997

[30] Foreign Application Priority Data

Apr. 26, 1996 [JP] Japan ..... 8-129249

[51] Int. Cl.[6] ..... E05C 3/06

[52] U.S. Cl. ..... 292/201; 292/216; 292/DIG. 23

[58] Field of Search ..... 292/201, 216, 292/341.16, 196, DIG. 23, DIG. 65, DIG. 43

[56] References Cited

U.S. PATENT DOCUMENTS

| | | | |
|---|---|---|---|
| 4,762,348 | 8/1988 | Matsumoto | 292/216 |
| 4,848,031 | 7/1989 | Yamagishi et al. | 292/DIG. 72 |
| 4,968,074 | 11/1990 | Yamagishi et al. | 292/216 |
| 4,986,579 | 1/1991 | Ishikawa | 292/201 |
| 5,273,324 | 12/1993 | Kobayashi | 292/216 |
| 5,308,128 | 5/1994 | Portelli et al. | 292/216 |
| 5,454,607 | 10/1995 | Ishihara et al. | 292/201 |
| 5,466,021 | 11/1995 | Ishihara et al. | 292/201 |
| 5,564,761 | 10/1996 | Mizuki et al. | 292/201 |
| 5,618,068 | 4/1997 | Mitsui et al. | 292/216 |
| 5,678,869 | 10/1997 | Yoshikuwa | 292/216 |

*Primary Examiner*—Suzanne Dino Barrett
*Assistant Examiner*—Teri Pham
*Attorney, Agent, or Firm*—Burns, Doane, Swecker & Mathis, LLP

[57] ABSTRACT

An apparatus for perfectly closing a door of a vehicle basically comprising a latch, a pawl, a motor, an active lever, a latch lever, a pawl switch, and a latch switch. The door closing begins with the action of the latch moving from the door half-closed to the closed position an shown by the switching off of the pawl switch with the latch switch turning on. The electric motor activates upon detecting the door half-closed position and stops when the closed position is reached.

3 Claims, 7 Drawing Sheets

DOOR CLOSING APPARATUS

BACKGROUND OF THE INVENTION

The present invention relates to an apparatus for closing a door of a vehicle, and more particularly to a door closing apparatus for bringing a door which is in a half-closed or latched condition automatically into a full-closed or latched condition.

Prior art attempts to produce a full-closed condition of a side door of a vehicle rely on the use of a structure which engages a striker which is a member of the body side of the vehicle with a latch comprising a part of a door lock apparatus provided on the side door. Referring to FIG. 8, there is shown a latch 1 which is universally pivotal around a pin 2 and which forced to be in one direction at all times due to the urging force of a spring 3. The latch 1 includes an engaging groove 5 receiving a striker 4, a first projection 6 producing the full-closed condition of the door in a periphery thereof, and a second projection 7 making the half-closed condition of the door, to have a protrusion 9 of a pawl 8 universally engaged with both projections 6 and 7.

The pawl 8 is universally pivotal around a pin 9' and forced to stay in the direction of the latch 1 at all times by a spring 10. The pawl 8 is rotatable counterclockwise by the movement of a pin 11' of a lift lever 11 of the opening system of the door lock mechanism.

When the door is in the open condition, the engaging groove 5 lies in the right direction as viewed in FIG. 8, and the protrusion 9 of the pawl 8 comes in contact with an outer periphery of the latch 1. Through the door closing operation, the striker 4 enters the engaging groove 5 and rotates the latch 1 forcibly counterclockwise, whereafter the protrusion 9 engages the second projection 7 to produce the half-closed condition of the door or the half-latch status, while a further door-closing operation permits the protrusion 9 to engage the projection 6, thus producing the full-closed condition of the door or the full-latch status (a condition shown in FIG. 8).

Note that 30 denotes a latch switch for detecting either one of door conditions of door open, door half-closed, or door full-closed conditions.

In the aforementioned operation of the conventional door closing apparatus, in the event of insufficient operating power or the like, the door closing operation may terminate while the door remains to be in the half-closed condition with the protrusion 9 of the pawl 8 still being engaged with the second projection 7. Consequently, a door closer mechanism is used to bring the door in the half-closed condition automatically into the full closed condition. Examples of this type of door closer are disclosed in Japanese Patent Laid-Open Publication Nos. 96079/1990 and 50045/1994.

It is known that the door closing mechanism employs a construction wherein a latch lever rotating the rotatable shaft of the latch is abutted on an active latch secured to an active lever which ascends and descends by the electric motor so that the latch lever is rotated according to the operation of the active latch. Upon detection of the half-closed condition of the door, the electric motor operates the active lever, such operation being transmitted via the active latch to the latch lever and automatically moving the latch from a position (half-latch status) corresponding to the half-closed condition of the door to a position (full-latch status) corresponding to the full-closed condition of the door according to the rotation of the latch lever.

However, the conventional door closing apparatus operate on a procedure, wherein the electric motor activates closing operation upon sensing that the latch switch is turned on or off, thereby creating a slight timing lag between the moment the latch switch is turned on or off and the moment the door reaches the half-closed condition, wherefore it cannot necessarily be maintained that the electric motor is operated for closing the door upon detecting the half-closed condition of the door. Further, there is another adverse factor, namely, a possibility that the closing operation is continued because of the lack of detection of the completely closed condition of the door.

SUMMARY OF THE INVENTION

Accordingly, it is an object of the present invention to provide a door closing apparatus to solve the aforementioned problems.

Basically, the present invention employs the following concept; in which a latch moves from the first position to the second position, when a pawl switch turns off from the "on" status and the latch switch turns on to indicate the second position, the half-closed condition of a door is detected to cause a electric motor to rotate in the door-closed direction, whereas in the process the latch moves from the second position to the third position, when the pawl switch turns off from the "on" status and the latch switch turns on to indicate the third position, the electric motor comes to a stop.

Accordingly, it is another object of the present invention to provide a door closing apparatus which is constructed to complete door closure by eliminating any time lag between the time of the switching operation of the latch switch and the time of the door reaching the half-closed condition. It is further object of the present invention to provide a door closing apparatus which is designed to terminate the closing operation upon detection of the full-closed condition of the door.

Specifically, the door closing apparatus of the present invention comprises a latch taking selectively the first position in which the door is in the openable condition with respect to the member of the body side, the second position of the half-closed condition, or the third position of the full-closed condition, a pawl maintaining any one of the above-mentioned positions as taken by the latch, a motor activating by detecting the half-closed condition of the door, an active lever moving along a fixed linear path by means of the output of the electric motor, a latch lever having a free end which is fixed to the latch and operates in cooperation with the active lever, a pawl switch turning on and off according to the movement of the pawl, and a latch switch turning on and off according to the movement of the latch. Moreover, the door closer apparatus is characterized by an operation in which during the process wherein the latch moves from the first position to the second position, when the pawl switch turns off from the "on" status and the latch switch turns on to indicate the second position, the half-closed position of the door is detected to rotate the electric motor in the door-closed direction, whereas during the process wherein the latch moves from the second position to the third position, when the pawl switch turns off from the "on" status and the latch switch turns on to indicate the third position, the electric motor comes to a stop.

Inasmuch as the door closing apparatus of this type can verify the full-closed condition of the door by means of the pawl switch and the latch switch, any wasteful closer operation is spared. In addition, the apparatus can check door closing condition with good accuracy so that the electric motor is operated in reverse, thereby making it possible to release over-closure caused by the electric motor and removing unpleasant noise produced by the reaction of the door.

BRIEF DESCRIPTION OF THE DRAWINGS

The foregoing and further objects, features, and advantages of the present invention will become apparent from the following description of a preferred embodiment with reference to the accompanying drawings, wherein.

DETAILED DESCRIPTION OF PREFERRED EMBODIMENT

Figure 1:
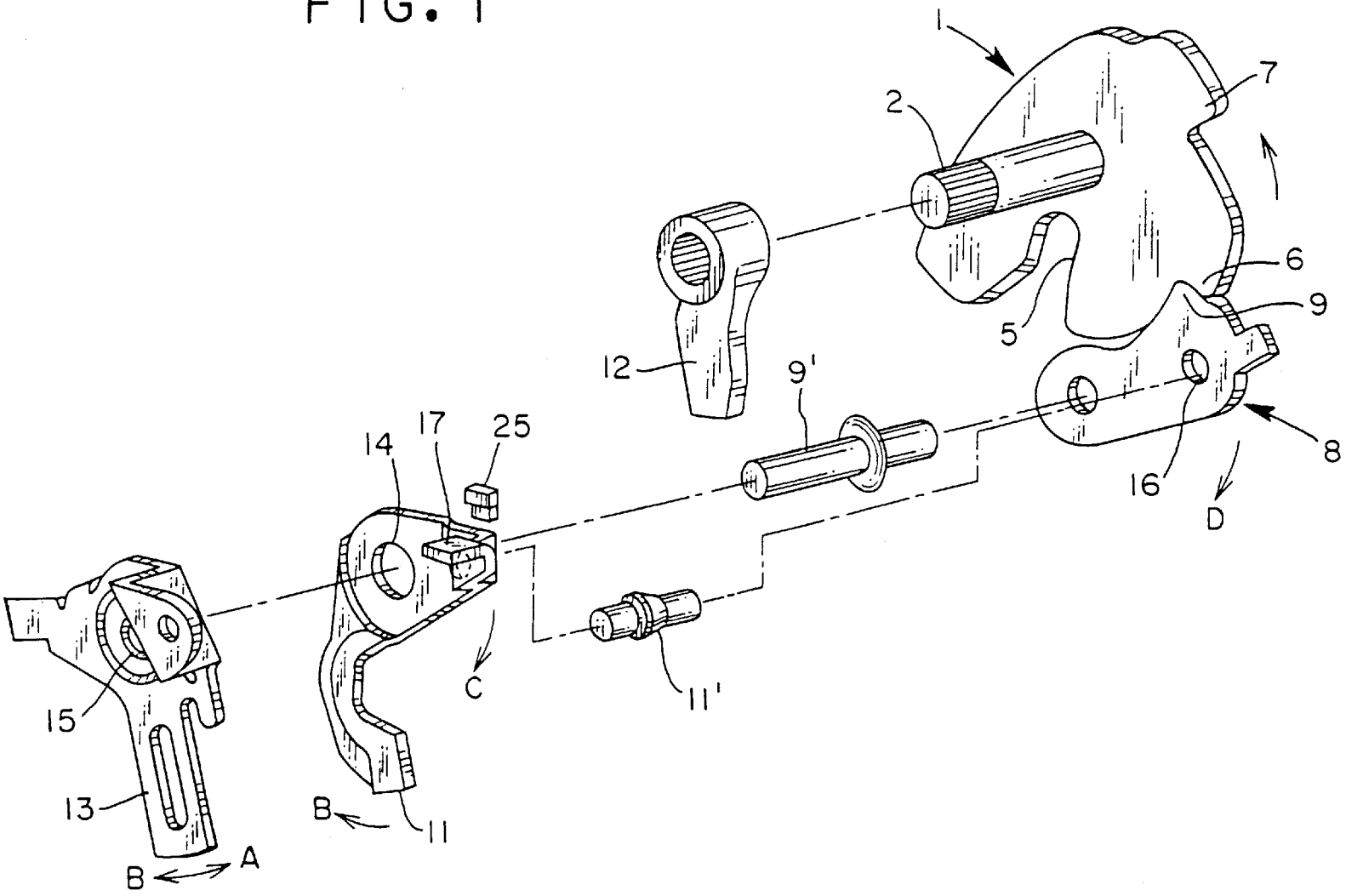
FIG. 1 is a perspective view of a part of the opening system of the door locking apparatus.

A preferred embodiment of this invention as shown in FIGS. 1 through 5 basically comprises a latch 1, a pawl 8, a motor M, an active lever 20, a latch lever 12, a pawl switch 25, and a latch switch 30.

Figure 2:
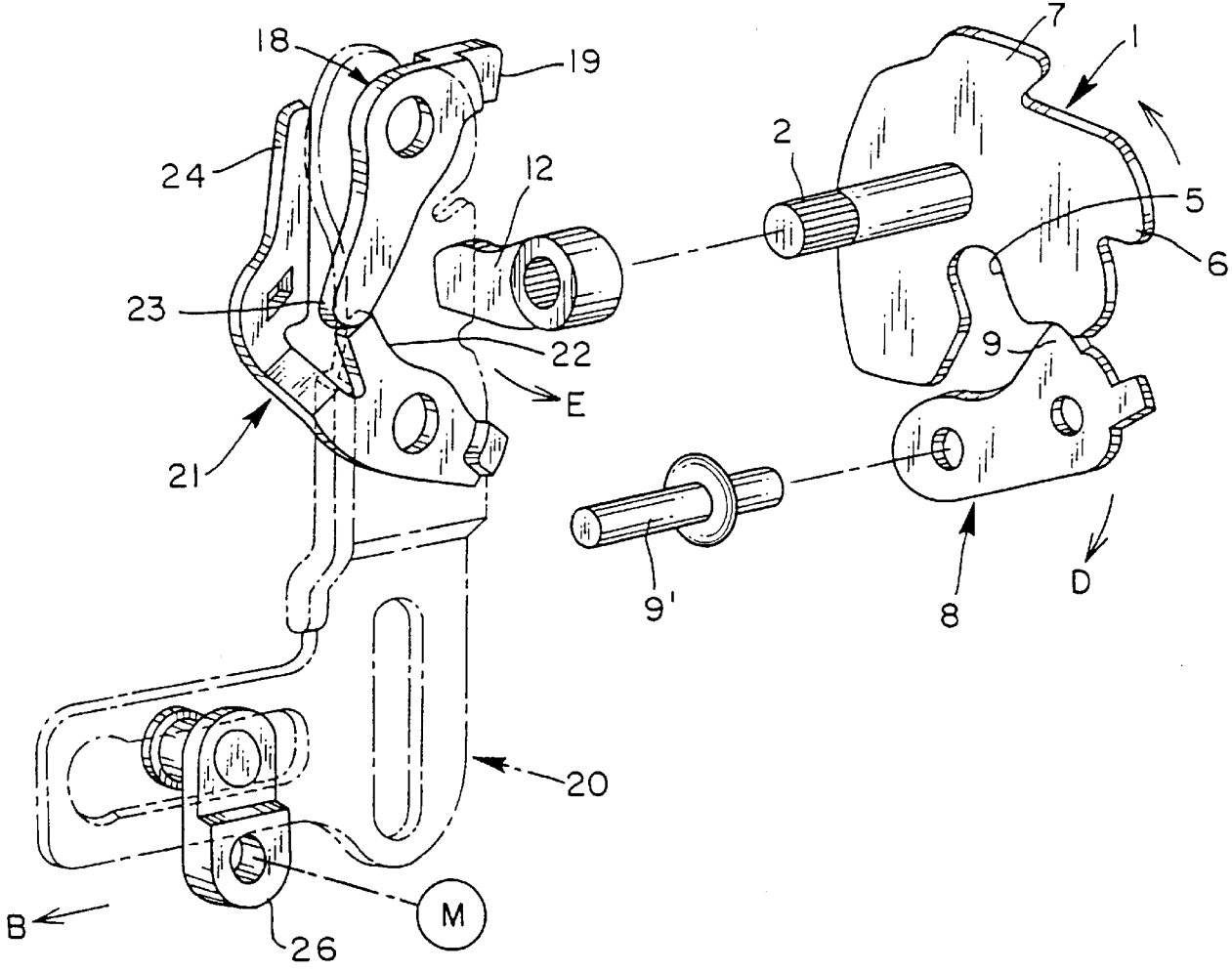
FIG. 2 is a perspective view of a door closer part of the door locking apparatus.
Figure 8:
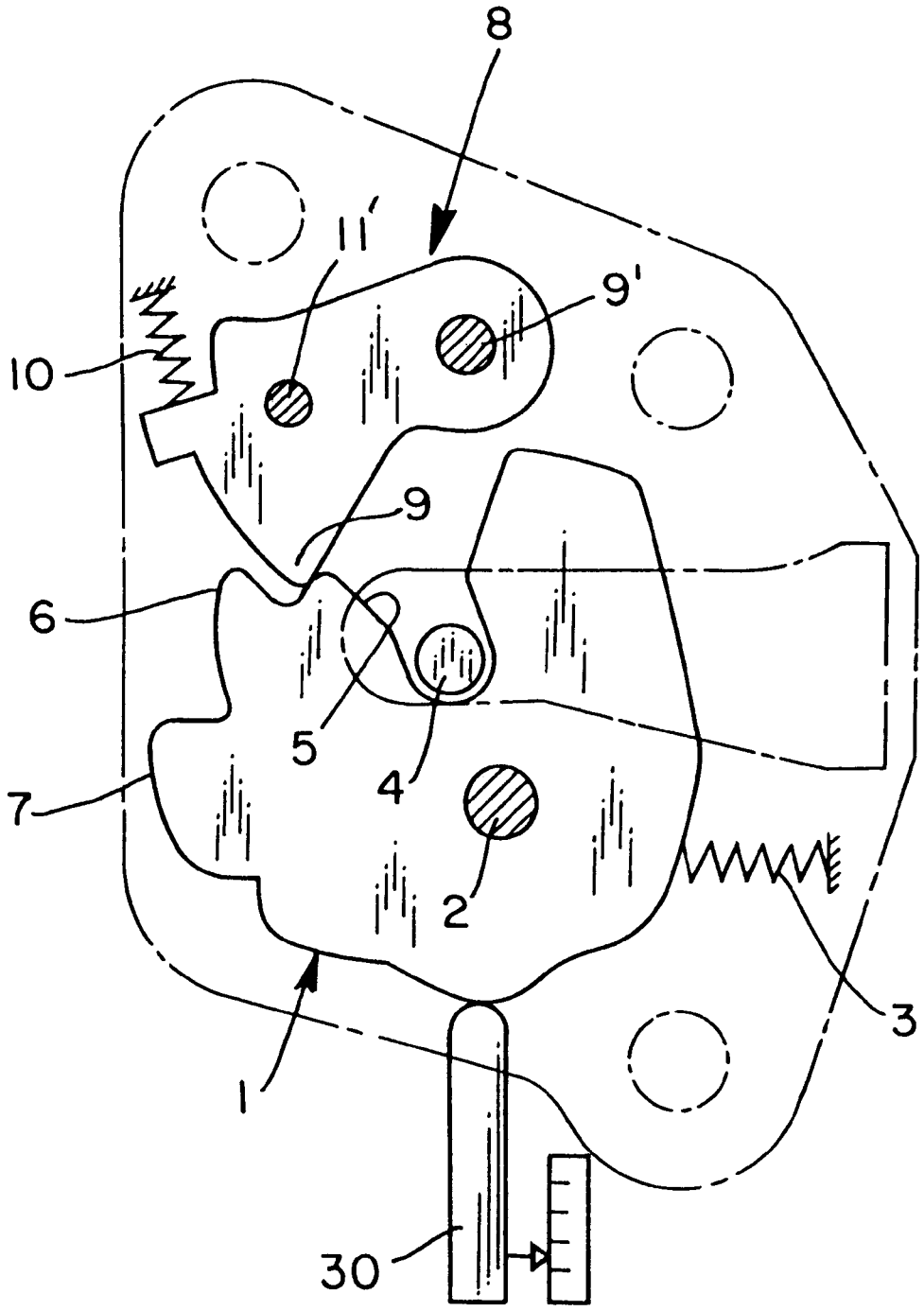
FIG. 8 is a plan view showing the relationship between the latch and the pawl.

First referring to FIGS. 1 and 2, the latch lever 12 is affixed to a pin 2 of the latch 1, a pin 9' of the pawl 8 is inserted into fitting holes 14 and 15 of a lift lever 11 and an open lever 13, and a pin 11' of the lift lever 11 is inserted into a hole 16 of the pawl 8. In response to the movement of the lift lever 11 operated according to opening and closing operations of a door, the pin 11' rotates the pawl 8 clockwise (as viewed in FIG. 8) around the pin 9' and releases a protrusion 9 from contact thereof with projections 6 and 7. Namely, the open lever 13 is universally rotatable in the direction of A or B (in the door open direction). When the lever 13 is rotated in the direction of B in the example of FIG. 1, the lift lever 11 rotates in the direction of B, pivoting a segment 17 thereof in the direction of C and pushing down the pin 11'. Next, the pawl 8 is rotated in the direction of D, releasing the protrusion 9 from the projections 6 and 7 and creating an unlatched status (latch release) to enable the door to open.

A free end of the latch lever 12 is set against a segment 19 of an active latch 18 subjected to the urging force of a spring. The L-shape active latch 18 is rotatably connected to an active lever 20 and an active pawl subjected to the urging force of the spring, that is, a cancel lever 21 is connected by a pin to the active lever 20. The active pawl or the cancel lever 21 is approximately in the V shape, having a first arm 22 thereof in contact with a free end 23 of the active latch 18 as well as a long second arm 24. A contact of the free end 23 with the first arm 22 blocks the counterclockwise rotation of the active latch 18 as viewed in FIG. 2.

Upon completion of the door closing operation, when the pawl switch 25 (refer to FIG. 1) detects the half-closed condition of the door, the electric motor M activated to rotate an output lever 26 thereof, moving the active lever 20 downward as viewed in FIG. 2. As a result, the segment 19 of the active latch 18 comes into contact with the free and of the latch lever 12, causing the latch lever 12 to rotate in the direction of E (as viewed in FIG. 2) and automatically bringing a pin 2, which is an integral part of the latch lever 12, and the latch 1 from a position of the half-latched status to a position of the full-latched status.

When the active latch 13 is in contact with the latch lever 12, the free end 23 of the active lever 18 is in contact with the active pawl or the first arm 22 of the cancel lever 21 to block the counterclockwise rotation (as viewed in FIG. 2) of the active latch 18, thus enabling the latch lever 12 to rotate in the direction of E. It is noted that the active latch 18 is rotatable clockwise.

In the event that clothes, hand baggage, and the like are grasped between the door and the body during the door closing operation resulting in changing the door position from the open condition to the half-closed condition, it is necessary to cancel the door closing operation by the door closer.

Figure 3:
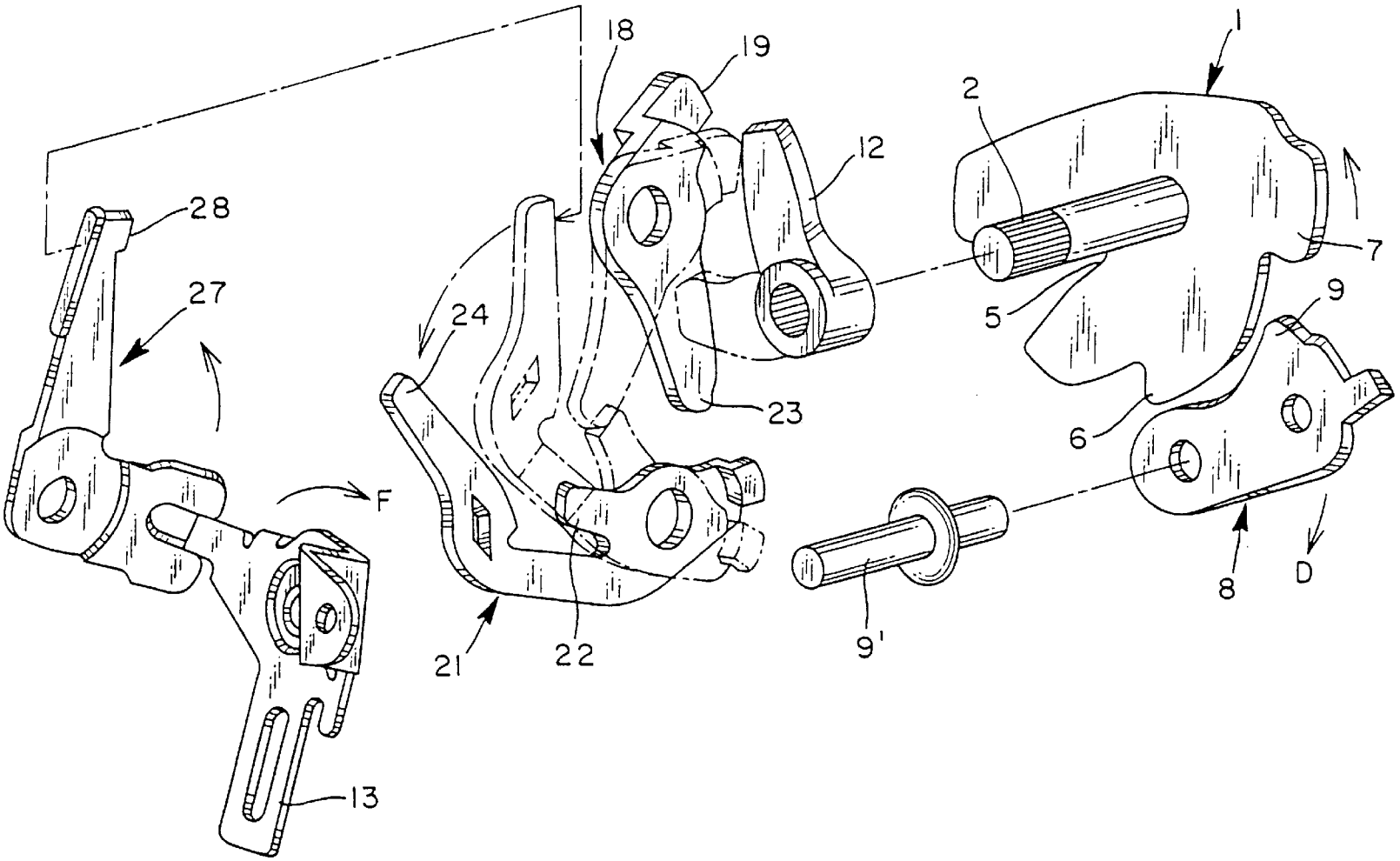
FIG. 3 is a perspective view to illustrate cancel operation.

When an object is held by the door, a door opening operation by operating the handle would cause an intermediate lever 27 to rotate counterclockwise as viewed in FIG. 3, making the open lever 13 rotate in the direction of F (equivalent to the direction of B in FIG. 1) and producing the same movement as the door opening movement explained in connection with FIG. 1. Such motion of the intermediate lever 27 causes a free end 28 thereof to come in contact with the second arm 24 of the active pawl 21, moving the active pawl 21 to a position shown in solid lines in FIG. 3. Consequently, engagement of the first arm 22 of the active pawl 21 with the free end 23 of the active latch 10 is released to put the active latch 18 in the universally pivotal condition.

When the pawl switch 25 detects the half-closed condition of the door in this state, as described in connection with FIG. 2, the electric motor M pushes down the active lever 20 and the active latch 18. However, since engagement of the first arm 22 of the active pawl 21 with the free end 23 of the active latch 18 is released, even if the segment 19 comes in contact with the latch lever 12, the active latch 18 rotates universally while there is no rotation of the latch lever 12. In this manner, there is no shift of the door position from the half-closed condition to the full-closed condition, and yet the door opening operation is performed.

Figure 4:
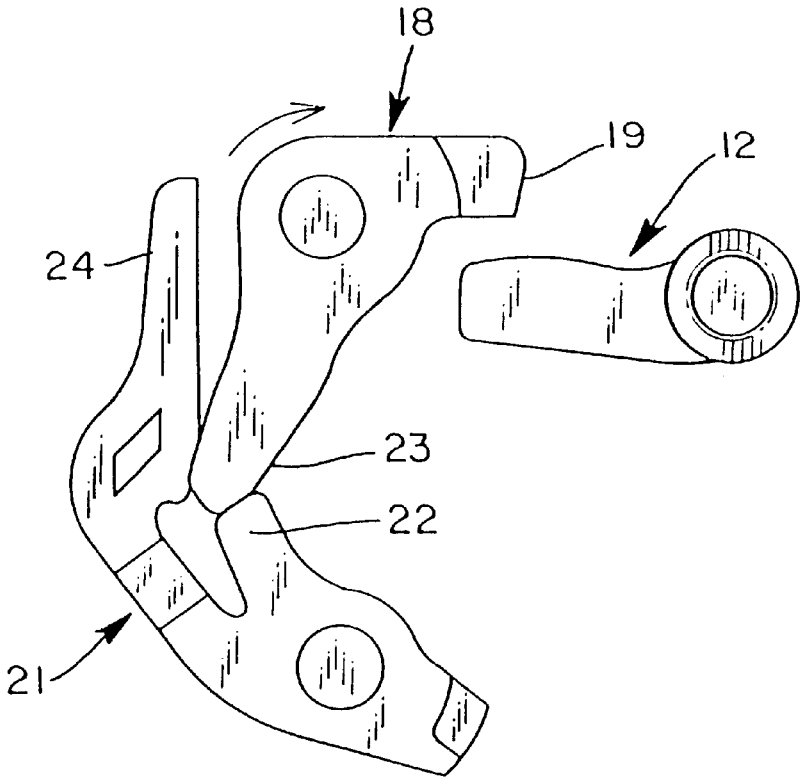
FIG. 4 is a diagram showing the normal relationship between the active latch and the latch lever.
Figure 5:
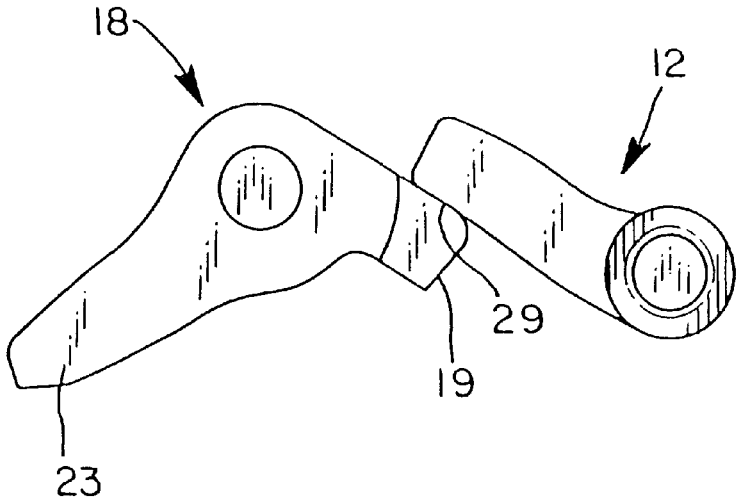
FIG. 5 is a diagram showing an abnormal relationship between the active latch and the latch lever.

In the above-mentioned operation, the free end of the latch lever 12 is positioned under the segment 19 of the active latch 18 as shown in FIG. 4, thereby enabling the active latch 18 to rotate counterclockwise upon rotation of the latch lever 12 or when the active pawl 21 is rotated counterclockwise. It is noted, however, that the door opening during the cancel operation may bring about a positional relationship as shown in FIG. 5 due to the freedom of rotation of the active latch 18, namely, an abnormal condition in which the free end of the latch lever 12 is positioned above the segment 19. In this instance, as a result of the door closing operation, the latch lever 12 is rotated counterclockwise by the latch 1 to put the segment 19 of the active latch 18 in contact with the free end of the latch lever 12, rotating the active latch 18 universally clockwise as viewed in FIG. 5 to obtain the normal condition shown in FIG. 4.

This avoidance of abnormality is accomplished by making the active latch 18 universally rotatable clockwise as viewed in FIGS. 4 and 5.

To avoid such abnormality, as shown in FIG. 5 the side which forms the free end of the latch lever 12 and which comes in contact with the segment 19 of the active latch 18 is so constructed as to form on incline 29. In the above-mentioned door closing operation, the latch lever 12 rotates counterclockwise to rotate the active latch universally, whereas the incline 29 reduces a slide therebetween as well an a contact stroke at the contact part, thus enabling the latch lever 12 to return promptly to the normal position.

Figure 6:
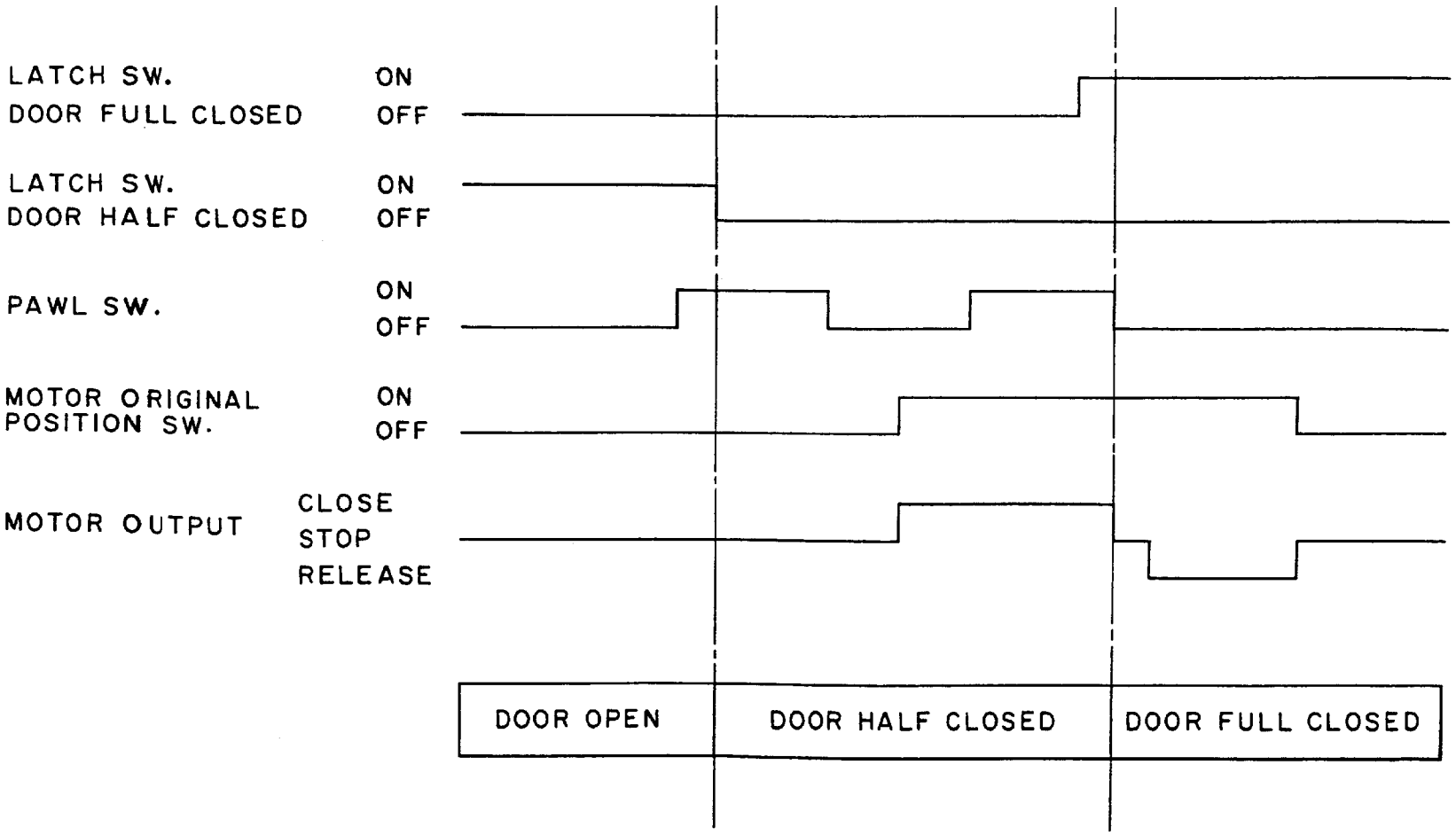
FIG. 6 is an explanatory diagram showing the operational relationship among the latch switch, the on and off status of the pawl switch, and the electric motor.

Referring to FIG. 6, a description of the closing rotation and release rotation of the electric motor M subsequent to the switching operations of the pawl switch 25 and the latch switch 30 (see FIG. 8) will be provided.

In the process in which the door is closed from the open condition to the closed condition, the pawl switch 25 is turned on by the rotation of the lift lever 11, whereupon as the latch switch 30 enters from the door open condition to the door half-closed condition, the latch switch 30 turns off from the "on" status. When the door is completely in the half-closed condition, the pawl switch 25 turns off and the electric motor M, detecting this switching-off operation, starts rotation for closings. Thus, the operational characteristics shown in FIGS. 6 and 7 indicate that a judgment device judges the half-closed condition of the door when the pawl switch 25 turns to off from the "on" status and the latch switch 30 turns to the off status. In the process in which the door moves to the full-closed condition, the pawl switch 25 turns on, whereupon the latch switch 30 turns on to indicate that the door has entered the full-closed condition, then the pawl switch 25 turns off from the "on" status. Detecting this switching-on operation of the pawl switch 25, the electric motor M comes to a halt, then starts rotation for releasing.

As clear from FIG. 6, this example is characterized in that upon detection of two signals of the "off" signal of the latch switch 30 and the "on"-to-"off" transfer signal of the pawl switch 25 showing that the door has reached the half-closed condition, the electric motor M starts rotation for closing, while as soon as the latch switch 30 detects the full-closed condition of the door and outputs the "on" signal and the pawl switch 25 outputs the "on" to "off" transfer signal, the electric motor M makes a stop, then begins rotation for releasing. Thus, the operational characteristics shown in FIGS. 6 and 7 indicate that the motor M is controlled by a control device based on the status of the pawl switch and the latch switch.

Figure 7:
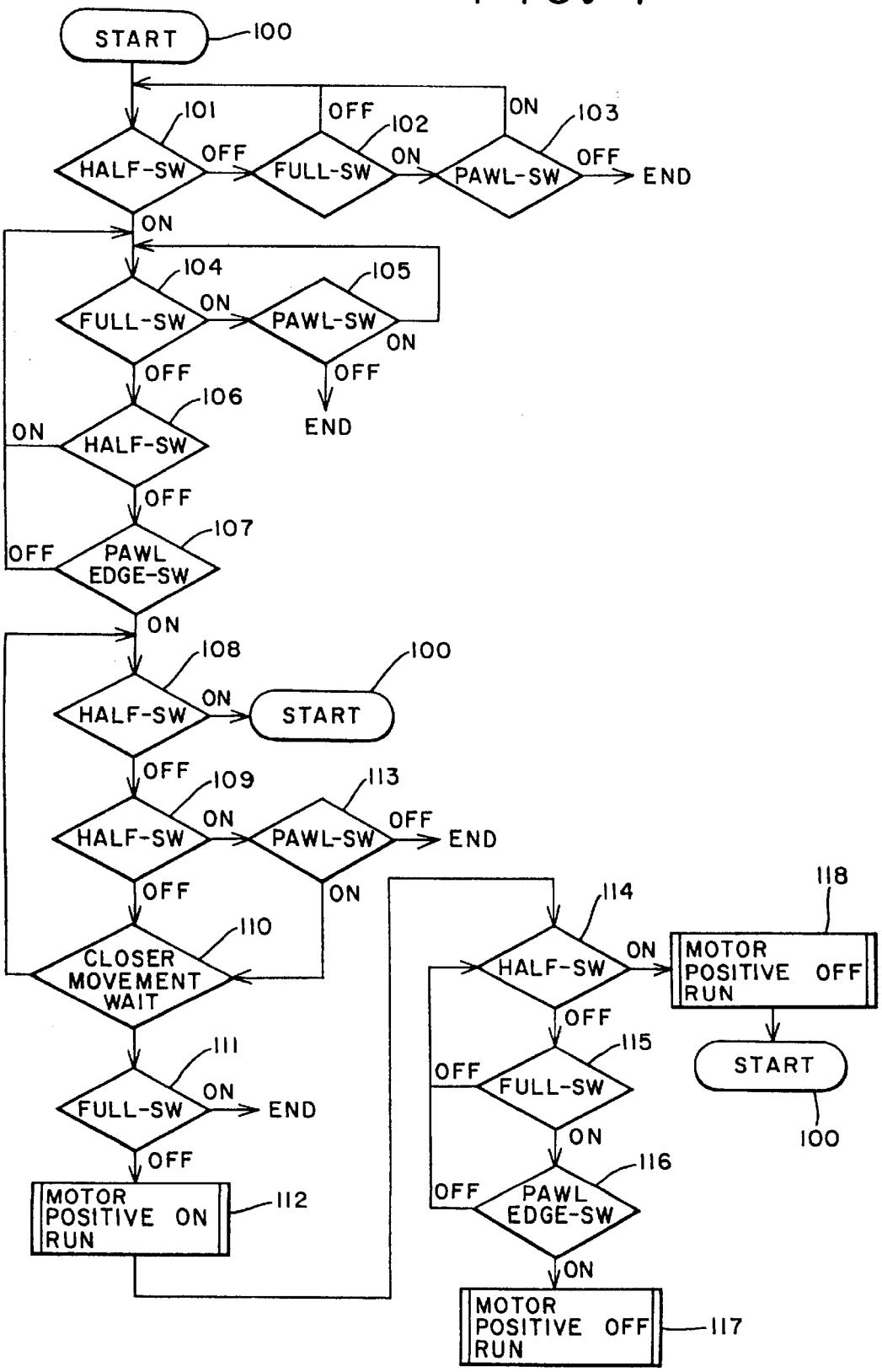
FIG. 7 is a flow chart indicating the operation of the closing apparatus.

The above-mentioned operation is shown in a flow chart in FIG. 7. Referring to FIG. 7, the Half-SW indicates that the latch switch 30 outputs the "on" signal with the door open and the "off" signal with the door in the half-closed condition, and the Full-SW shows that the latch switch 30 outputs the "on" signal when the door is in the full-closed condition. The Pawl-SW indicates the "on" and "off" status of the pawl switch 25, while the Pawl Edge-SW detects a transfer from the "on" to the "off" status of the Pawl-SW.

In the operation from the door opening to closing, after the Start 100 is activated, if the switching off of the Half-SW 101 and the switching on of the Full-SW 102 of the latch switch 30 follow and the Pawl-SW 103 outputs the "off" signal, then the door is in the full-closed condition, thus terminating the operation. The operation completes upon verification of the full-closed condition of the door by detecting the "off" signal from the Half-SW 101, the "on" signal from the Full-SW 104, and the "off" signal from the Pawl-SW 105.

Upon receipt of the "off" signal of the Full-SW 104 and the "off" signal of the Half-SW 106, the Door Half-Closed or the half-closed condition of the door is detected, then the pawl switch 25 is turned off from the "on" status by the Pawl Edge-SW 107. When the "off" signal of the Half-SW 108 and the "off" signal of the Full-SW 109 are checked at this point, approximately 0.3 second is normally allowed for the Closer Operation Wait 110, then after the "off" signal of the Full-SW 111 is confirmed, the Motor Positive Run 112 or rotation for closing is activated. When the Full-SW 109 is on and the Pawl-SW 113 is off, the door is in the full-closed condition and the operation terminates.

After the Motor Positive Run 112 or rotation for closing, the "off" signal of the Half-SW 114 and the "on" signal of the Full-SW 115 are checked and the transfer of the Pawl-SW 116 from the "on" to the "off" status is made, whereupon the positive run of the electric motor stops as shown in 117, then the rotation of the electric motor for releasing begins.

The "on" status of the Half-SW 114 shows that the cancel operation is in progress: the Motor Positive Run Off 118 signal is received to return to the Start 100.

While the present invention has been described in regard to what is currently considered to be a preferred embodiment thereof, it is understood that the invention is not limited to the disclosed embodiment or construction. To the contrary, the invention is intended to cover various modifications and equivalent arrangement included within the spirit and scope of the appended claims.

What is claimed is:

1. A door closing apparatus for use in a door of a vehicle comprising:

a latch adapted to selectively assume a first position to provide the door with an openable condition relative to a member on a body side of a vehicle, a second position to provide the door with a half-closed condition relative to the member on the body side of the vehicle, or a third position to provide the door with a full-closed condition relative to the member on the body side of the vehicle;

a pawl engageable with the latch for maintaining the latch in any one of the first, second and third positions;

a motor adapted to be activated upon detecting the half-closed condition of the door;

an active lever movable by way of output of the motor for moving the latch from the second position to the third position;

a pawl switch adapted to turn on or off according to the movement of the pawl;

a latch switch adapted to turn on or off according to the movement of the latch;

judgment means for judging the condition of the door based on whether a status of the pawl switch is on or off and whether a status of the latch switch is on or off;

control means for controlling operation of the motor according to the status of the pawl switch and the latch switch; and the judgement means judging the condition of the door as the half-closed condition when the pawl switch turns to the status from the on status and the latch switch turns to the off status to indicate the second position of the latch while the latch shifts from the first position to the second position, and the control means operating the motor in a door closure direction when the half-closed condition is judged by the judgement means and stops operation of the motor when the pawl switch turns to the off status from the on status and the latch switch turns to the on status to indicate the third position of the latch while the latch shifts from the second position to the third position.

2. A door closer apparatus according to claim 1, wherein the pawl switch is on when the latch is in the first position.

3. A door closing apparatus for use in a door of a vehicle comprising;

a latch adapted to selectively (assuming) assume a first position to provide the door with an openable condition relative to a member on a body of a vehicle, a second position to provide the door with a half-closed condition relative to the member on the body of the vehicle, or a third position to provide the door with a full-closed condition relative to the member on the body of the vehicle;

a pawl movable in response to movement of the latch for maintaining the latch in any one of the first, second and third positions;

a motor adapted to be rotated in one direction upon detecting the half-closed condition of the door;

an active lever movable by way of the rotation of the motor;

a pawl switch adapted to turn on or off according to the movement of the pawl;

a latch switch adapted to turn on or off according to the movement of the latch;

control means for controlling the rotation of the motor according to the on or off status of the pawl switch and the latch switch; and the control means stopping rotation of the motor in the one direction when the pawl switch turns to the off status from the on status and the latch switch turns to the on status to indicate the third position of the latch while the latch shifts from the second position to the third position, and the control means rotating the motor in another direction after the rotation of the motor in the one direction is stopped.

* * * * *

UNITED STATES PATENT AND TRADEMARK OFFICE

CERTIFICATE OF CORRECTION

PATENT NO. : 5,944,367

DATED : August 31, 1999

INVENTOR(S) : Tomoaki IMAIZUMI et al

It is certified that error appears in the above-indentified patent and that said Letters Patent is hereby corrected as shown below:

On the title page, Section [75], delete "Akizauki" and insert -- Akizuki --.

Signed and Sealed this

Twelfth Day of September, 2000

*Attest:*

Q. TODD DICKINSON

*Attesting Officer*

*Director of Patents and Trademarks*